United States Patent [19]

Buys

[11] 4,008,891

[45] Feb. 22, 1977

[54] DISTRIBUTOR OF SHEETS IN WADS

[75] Inventor: Henri Buys, Arpajon, France

[73] Assignee: Transac-Compagnie pour le Development des Transactions, Paris, France

[22] Filed: Oct. 16, 1975

[21] Appl. No.: 623,069

[30] Foreign Application Priority Data

Oct. 18, 1974 France ..... 74.35088

[52] U.S. Cl. ..... 271/263; 271/172

[51] Int. Cl.² ..... B65H 7/12

[58] Field of Search ..... 271/262, 263, 64, 172

[56] References Cited

UNITED STATES PATENTS

| | | | |
|---|---|---|---|
| 2,337,064 | 12/1943 | Peters | 271/262 X |
| 2,890,884 | 6/1959 | Mestre | 271/262 |
| 3,591,170 | 7/1971 | Doughty | 271/263 |

*Primary Examiner*—Richard A. Schacher

[57] ABSTRACT

An improvement in a distributor of sheets in wads, comprising a detector for the simultaneous passing of several sheets in the vicinity of the output of a distributor, the detector controlling the directing of the sheets towards a particular receptacle and comprising an eccentric wheel and a device for the detection of rotation of the wheel when a plurality of sheets pass between the wheel and an opposing support.

5 Claims, 1 Drawing Figure

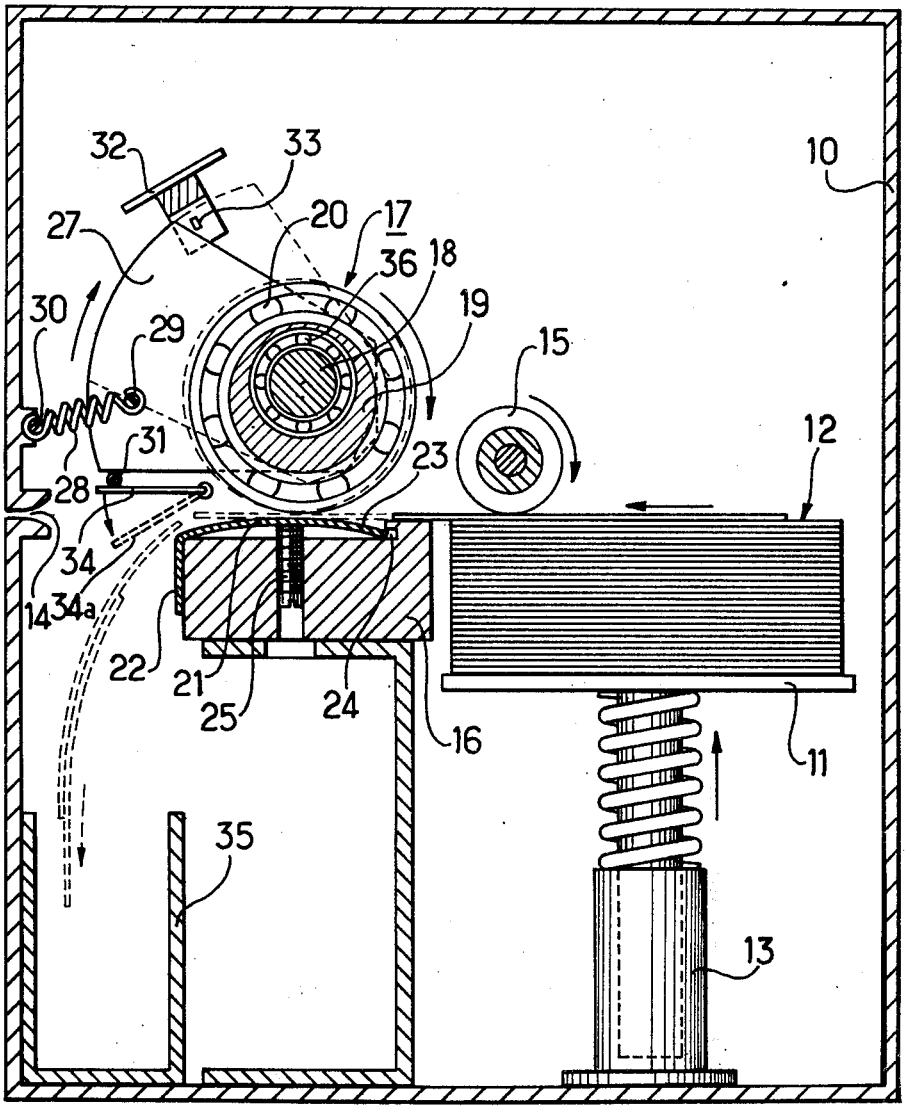
32
33
10
27
20
17
36
18
30
29
19
15
31
12
28
23
34
14
34a
22
21
25
24
16
11
35
13

DISTRIBUTOR OF SHEETS IN WADS

The present invention relates to distributors of sheets of paper such as bank notes and or the like, in which the sheets are stored in wads and are extracted one by one.

A difficulty to be overcome in the technical production of distributors is that two sheets of paper can stick together, for example because of electrostatic forces, and these two sheets can be distributed simultaneously.

An object of the invention is to provide a device which can easily be adapted to a machine for distributing sheets one by one and enabling, on the one hand, the detection of the simultaneous passing, at the output of the distributor, of two or more sheets and, on the other hand, the controlling of an element making it possible to direct the sheets towards a particular receptacle.

According to the invention, there is provided, a device for the detection, in a machine for distributing sheets in wads comprising a receptacle for the wads and a means for extracting sheets one by one through an orifice, of the simultaneous presence of several sheets in the vicinity of the said orifice and upstream therefrom, the said device being characterized in that it comprises a support having a substantially planar top portion on which the sheets extracted from the wad pass, an eccentric wheel having a stationary axle about which it can pivot, parallel to the said substantially plane portion and perpendicular to the direction of movement of the sheets, the said wheel being arranged in the vicinity of the planar portion of the support, so that its portion which is the nearest to the planar portion is spaced from the latter by a length greater than the thickness of one sheet and less than the thickness of two sheets, the wheel being provided with first means for keeping it in a fixed angular position when there is at the most one sheet between the support and the wheel, and in said position, a vertical line passing through the center of the wheel passes through the said stationary axle or passes slightly downstream from the said axle in relation to the direction of movement of the sheets and with second means for detecting rotation of the wheel for controlling an element for directing sheets towards a particular receptacle, the said rotation taking place when several sheets arrive simultaneously between the wheel and the support.

According to a preferred embodiment, the second means comprises a part integral with the wheel, substantially in the shape of a circular sector, disposed in a plane perpendicular to the stationary axle of the wheel and an electro-optical circuit comprising a light source and a photoelectric cell controlling, when the light beam is interrupted, the said element for directing the sheets, the said circuit being arranged so that the beam is blocked when the sector pivots upon rotation of the wheel.

The means for keeping the wheel in a fixed angular position comprises a fixed stop on which one of the sides of the sector-shaped part bears, the said part being pulled back by a spring having slight strength stretched between the part and a fixed point of the distributor.

According to a particular embodiment, the substantially planar portion of the support is constituted by a flexible rectangular plate a first of whose sides, perpendicular to the direction of movement of the sheets is stationary, a second side which is parallel to the first is free, the distance between the plate and the wheel being adjustable by means of a screw bearing on the plate on its face which is not adjacent to the wheel.

According to a preferred embodiment, the wheel comprises a first ball bearing installed on a shaft surrounded by an eccentric ring, itself surrounded by a second ball bearing.

The invention will be better understood from the following description of a preferred embodiment of the invention given by way of illustation but having no limiting character, with reference to the accompanying drawing, in which:

The single FIGURE shows a cutaway elevation view of a bank-note distributor provided with a device for detecting the simultaneous passing of several notes and for controlling the direction of their travel.

The distributor comprises, in a known manner, a magazine 10 in which is placed, on a support 11, a wad or stack of notes 12 to be distributed one by one. The support is urged upwards by a servo-controlled device 13 so that the top of the wad be always at the level of an output orifice 14. The sheets are ejected one by one by any known means, for example by a friction roller 15 driven in rotating movement by suitable means (not shown).

A device for making it possible to detect whether several notes are drawn from the wad simultaneously comprises:

A support 16, which is stationary in relation to the magazine and whose substantially planar top part is situated at the level of or slightly below the top of the wad so that the notes slide on said planar surface.

An eccentric wheel 17, spaced above the support. The wheel is mounted on a shaft 18 which is stationary in relation to the magazine and whose axis constitutes a pivot axis for the wheel, said shaft extending perpendicular to the direction of pay-out of the notes and parallel to the plane of the support 16; a first ball bearing 36 is installed on the shaft 18 and a ring 19, which is eccentric in relation to the shaft 18 and to the bearing 36, itself surrounded by a second ball bearing 20, is arranged around the bearing 36.

The minimum distance between the wheel 17 and the support 16 is chosen so as to be equal to the thickness of one note and in any case less than the thickness of two notes. The distance can be adjusted by forming the top part of the support 16 with a resilient plate 21 (for example made of stainless steel), attached at one side 22 to the support and engaged at the opposite side 23 in a notch 24 formed in the support.

The attaching means 22 is adjustable by an adjusting means — not shown); a finish — adjustment is obtained by an adjusting screw 25.

As will be explained further, when there is no note under the wheel or when only one note at a time arrives under the wheel, the wheel remains stationary. When two or more notes arrive simultaneously, the wheel pivots because of the friction exerted by the notes. As the wheel is eccentric, it does not offer any resistance to the passing of the notes, thus avoiding any jamming.

The detection of the rotation of the wheel is obtained by means of a planar plate 27, in the shape of a circular sector, integral with the wheel.

The sector is biassed against a stop 31 by a spring 28 having slight strength, stretched between a fixed point 29 on the sector and a fixed point 30 on the magazine.

When there is note or is no only one note passes under the wheel, the sector, pulled back by the spring, remains stationary on the stop 31, thus imparting to the wheel a stationary angular position. Indeed, the friction due to the passing of the note is zero or too slight to overcome the strength of the spring.

In this position, which is the rest position, a vertical line passing through the center of the wheel passes through the stationary axis or passes downstream of the pivoting axis in relation to the direction of pay-out of the notes.

If several notes arrive simultaneously, the friction force due to the notes is greater than the strength of the spring and the wheel and sector assembly rotates, allowing the free passing of the notes.

An electro-optical device 32, comprising a light source and a photoelectric cell enables the detection of the rotation of the wheel. Indeed, such device is placed so that the light beam 23 (perpendicular to the axis of the drawing) will not be blocked by the sector when the latter is in the rest position, where as the light beam will be blocked by the sector upon rotation of the latter corresponding to the passing of more than one note at a time.

The electro-optical device controls, in a known fashion, a device for directing notes, for example, a plate 34 normally in the horizontal position but which can rotate under the effect of the electro-optical device (to position 34*a*) to direct the notes towards a receptacle 35 and prevent the notes from coming out through the orifice 14.

After the discharge of the notes into the receptacle 35, the sector 17, under the effect of the spring 28, returns to the rest position against stop 31.

The means for detecting the rotation of the wheel which has just been described is only one example for which there can be variants.

The sector can be omitted and replaced by a hole in the wheel itself, through which the light beam passes.

Due to its diameter which is very much greater than that of the wheel, the sector has the advantage of imparting to the device great sensitivity and, by means of the spring 28, of conveniently solving the problem of the holding of the wheel in a stationary angular position when there is only one note or no note at all.

Nevertheless, the electro-optical device could be replaced by any other known device such as a magneto-optical device or a device having a variation in capacity, etc.

The invention is not limited to the distributing of bank notes, but applies to the distributing of sheets of any kind one by one.

It must be understood that the invention is not limited to the embodiment described and illustrated, which has been given only by way of example. More particularly, without going beyond the scope of the invention, details may be modified, certain arrangements may be changed or certain means may be replaced by equivalent means.

I claim:

1. In a machine for distributing individual sheets from a stack comprising a receptacle for the stack, means for feeding the sheets one by one through an orifice in the receptacle, and detecting means for detecting the simultaneous presence of a plurality of sheets in the vicinity of the orifice and upstream therefrom, said detecting means comprising a support having a substantially planar top portion on which pass sheets extracted from the stack, an eccentric wheel, a stationary shaft rotatably supporting said wheel, said shaft extending parallel to the planar top portion and perpendicular to the direction of movement of the sheets, said wheel comprising a first ball bearing installed on said shaft, an eccentric ring mounted on said ball bearing, and a second ball bearing surrounding said eccentric ring, said wheel being arranged in the vicinity of the planar portion of the support but spaced therefrom such that the planar portion is spaced from the wheel by a distance at least equal to the thickness of one sheet and less than the thickness of two sheets, first means acting on the wheel for keeping it in a fixed angular position where there is, at most, one sheet between the support and the wheel, a vertical line passing through the center of said wheel in said fixed angular position passing through the center or slightly downstream of said stationary shaft in relation to the direction of movement of the sheets, and second means for detecting rotation of said wheel for diverting the passage of the sheets to the orifice, said rotation taking place when a plurality of sheets arrive simultaneously between the wheel and the support.

2. A machine as claimed in claim 1 wherein said second means comprises a part integral with the wheel, substantially in the shape of a circular sector, disposed in a plane extending perpendicular to said stationary shaft, an electro-optical circuit comprising a light source and a photoelectric cell, said sector being postioned such that in said fixed angular position of the wheel said electro-optical circuit is in one state whereas when said wheel is rotated said electro-optical circuit is in a second state, and an element for diverting the passage of the sheets to the orifice when said electro-optical circuit is in said second state.

3. A machine as claimed in claim 2 wherein said light source produces a light beam which passes to said photoelectric cell when the wheel is in said fixed angular position, said sector blocking passage of said light beam when the wheel is rotated.

4. A machine as claimed in claim 3 wherein said first means for keeping the wheel in the fixed angular position comprises a fixed stop, and a spring of slight strength acting on said part of circular sector shape to urge said part against said stop in said fixed angular position.

5. A machine as claimed in claim 1 wherein the substantially planar portion of said support is constituted by a resilient rectangular plate having a first side extending perpendicular to the direction of movement of the sheets which is fixed, and a second free side which is parallel to the first side and a screw bearing on the plate on the surface thereof remote from said wheel for adjusting the distance between said plate and said wheel.

* * * * *